US011519269B2

(12) United States Patent
Shu et al.

(10) Patent No.: US 11,519,269 B2
(45) Date of Patent: Dec. 6, 2022

(54) EXPANDER AND FLUID CIRCULATION SYSTEM COMPRISING SAME

(71) Applicant: EMERSON CLIMATE TECHNOLOGIES (SUZHOU) CO., LTD., Jiangsu (CN)

(72) Inventors: Hongfei Shu, Suzhou (CN); Donghui Yang, Suzhou (CN)

(73) Assignee: Emerson Climate Technologies (Suzhou) Co., Ltd., Jiangsu (CN)

( * ) Notice: Subject to any disclaimer, the term of this patent is extended or adjusted under 35 U.S.C. 154(b) by 0 days.

(21) Appl. No.: 17/259,895

(22) PCT Filed: Jul. 10, 2019

(86) PCT No.: PCT/CN2019/095407
§ 371 (c)(1),
(2) Date: Jan. 12, 2021

(87) PCT Pub. No.: WO2020/011192
PCT Pub. Date: Jan. 16, 2020

(65) Prior Publication Data

US 2021/0222555 A1 Jul. 22, 2021

(30) Foreign Application Priority Data

Jul. 12, 2018 (CN) ..... 201810763200.0
Jul. 12, 2018 (CN) ..... 201821105632.4

(51) Int. Cl.
*F01C 21/04* (2006.01)
*F01C 21/18* (2006.01)

(52) U.S. Cl.
CPC ..... *F01C 21/04* (2013.01); *F01C 21/18* (2013.01); *F05D 2250/71* (2013.01)

(58) Field of Classification Search
CPC ..... F04C 2240/809; F04C 2270/24; F01C 21/04; F01C 21/18; F01C 1/0207; F05D 2250/71
(Continued)

(56) References Cited

U.S. PATENT DOCUMENTS 7,918,096 B2 * 4/2011 Sakitani ..... F25B 31/004 62/468
2010/0101268 A1 4/2010 Sakitani et al.
(Continued)

FOREIGN PATENT DOCUMENTS

CN 101627265 A 1/2010
CN 208416615 U 1/2019
(Continued)

OTHER PUBLICATIONS

International Search Report (English and Chinese) and Written Opinion (Chinese) of the International Searching Authority issued in PCT/CN2019/095407, dated Sep. 25, 2019; ISA/CN.
(Continued)

*Primary Examiner* — J. Todd Newton
(74) *Attorney, Agent, or Firm* — Harness, Dickey & Pierce, P.L.C.

(57) ABSTRACT

An expander and a fluid circulation system comprising same are disclosed. The expander comprises a housing, an expansion mechanism, an exhaust pipe, an oil sump and a lubricant discharge channel. The expansion mechanism is provided in the housing to expand a high-pressure fluid into a low-pressure fluid. The exhaust pipe discharges the low-pressure fluid out of the expander and comprises an end portion assembled in a first opening of the housing and provided with an exhaust port; the low-pressure fluid enters the exhaust pipe via the exhaust port. The oil sump stores a lubricant in the housing. The lubricant discharge channel discharges the lubricant in the oil sump into the exhaust pipe
(Continued)

and/or an external system pipeline and comprises an inlet end having an inlet located at a predetermined oil level of the oil sump and an outlet end having an outlet.

19 Claims, 12 Drawing Sheets

(58) Field of Classification Search
USPC ..... 418/83
See application file for complete search history.

(56) References Cited

U.S. PATENT DOCUMENTS

| | | | | |
|---|---|---|---|---|
| 2016/0116196 | A1* | 4/2016 | Yoon | F25B 31/004 62/470 |
| 2016/0319816 | A1* | 11/2016 | Brostrom | F04B 49/10 |

FOREIGN PATENT DOCUMENTS

| | | | |
|---|---|---|---|
| EP | 2123996 | A1 | 11/2009 |
| JP | 3773836 | B2 | 5/2006 |
| JP | 2010150926 | A | 7/2010 |
| WO | WO-2014047536 | A1 | 3/2014 |

OTHER PUBLICATIONS

Extended European Search Report for Patent Application No. 19835003.5, dated Mar. 25, 2022.

* cited by examiner

EXPANDER AND FLUID CIRCULATION SYSTEM COMPRISING SAME

CROSS-REFERENCE TO RELATED APPLICATIONS

The present application is the national phase of International Application No. PCT/CN2019/095407 titled "EXPANDER AND FLUID CIRCULATION SYSTEM COMPRISING SAME" and filed on Jul. 10, 2019, which claims priorities to the following Chinese Patent Applications: Chinese Patent Application No. 201810763200.0 titled "EXPANDER AND FLUID CIRCULATION SYSTEM COMPRISING SAME", filed with the Chinese Patent Office on Jul. 12, 2018; and Chinese Patent Application No. 201821105632.4 titled "EXPANDER AND FLUID CIRCULATION SYSTEM COMPRISING SAME", filed with the Chinese Patent Office on Jul. 12, 2018. These patent applications are incorporated herein by reference in their entirety.

FIELD

The present disclosure relates to an expander and a fluid circulation system including same.

BACKGROUND

The contents of this section only provide background information related to the present disclosure, which may not necessarily constitute the prior art.

An expander is a device that outputs mechanical or electrical work to outside by expanding a high-pressure fluid into a low-pressure fluid. A common expander is a scroll expander. The expansion mechanism of the scroll expander includes an orbiting scroll component and a non-orbiting scroll component. The orbiting scroll component and the non-orbiting scroll component are engaged to each other to form a series of expansion chambers which gradually increase in volume between blades thereof, thereby causing the high-pressure fluid to become the low-pressure fluid. In the process of fluid expansion, a driving torque is generated, for example, to drive a shaft to rotate so as to output mechanical or electrical work.

Generally, the expander also includes an oil sump in which lubricant is stored, and the lubricant is provided to each relevant movable component (such as a main bearing) to lubricate it. In addition, in a system including the expander, the lubricant may enters the expansion mechanism of the expander with a high-pressure working fluid, and is discharged out of the expander with an expanded low-pressure working fluid, thereby circulating in the system. The lubricant circulating in the system may lubricate the expansion mechanism. Particularly, for a low-pressure side expander, since the lubricant in the oil sump is difficult to be supplied to the expansion mechanism due to the low-pressure environment, the expansion mechanism is mainly lubricated by the lubricant circulating in the system.

However, the lubricant in the system may separate from a working fluid when flowing through various components in the expander and flow into the oil sump in the expander. In this way, the amount of lubricant in the oil sump may be excessive, and accordingly, the amount of lubricant circulating in the system may be too little. This may lead to deterioration of lubrication condition of various relevant movable components in the expander, particularly the expansion mechanism, thereby affecting the normal operation of the expander and reducing the expansion efficiency.

Therefore, it is desired to provide an expander that is capable of improving lubricant distribution and maintaining good lubrication.

SUMMARY

An object of one or more embodiments of the present disclosure is to provide an expander capable of improving lubricant distribution and maintaining good lubrication.

Another object of one or more embodiments of the present disclosure is to provide an expander with a simple structure and low cost.

According to one aspect of the present disclosure, an expander is provided, which includes a housing, an expansion mechanism, an exhaust pipe, an oil sump and a lubricant discharge channel. The expansion mechanism is provided in the housing and is configured to expand a high-pressure fluid into a low-pressure fluid. The exhaust pipe is configured to discharge the low-pressure fluid out of the expander and includes an end portion fitted in a first opening of the housing and having an exhaust port, wherein the low-pressure fluid enters the exhaust pipe via the exhaust port. The oil sump is located in the housing and stores a lubricant. The lubricant discharge channel is configured to discharge the lubricant in the oil sump into the exhaust pipe and/or an external system pipeline communicated with the exhaust pipe, and the lubricant discharge channel includes an inlet end having an inlet and an outlet end having an outlet, wherein the inlet is located at a predetermined oil level of the oil sump, and the lubricant entering the lubricant discharge channel is discharged into the exhaust pipe and/or the external system pipeline via the outlet.

According to the above-mentioned expander, since the lubricant discharge channel for discharging excess lubricant from the oil sump into the exhaust pipe is provided, it may be ensured that the amount of lubricant in the oil sump is not excessive, while avoiding that the lubricant entering the system via the exhaust pipe is not too little, thereby ensuring that the expansion mechanism is well lubricated. In addition, according to the present disclosure, the lubricant is discharged from the oil sump to the exhaust pipe with the Bernoulli effect (that is, the pressure difference caused by the flow rate difference of the working fluid itself), and/or lubricant in the oil sump is discharged to the exhaust pipe with a pressure drop caused by a pipeline resistance loss, and thus the structure of the expander of the present disclosure is simplified.

In other examples of the present disclosure, the lubricant discharge channel is provided by a separate oil discharge pipe. In this way, the improvement or processing of certain structures of the expander may be avoided.

In other examples of the present disclosure, the oil discharge pipe is fixed to an inner wall of the housing. In this way, it is possible to make the structure of the expander compact to reduce an occupied space.

In other examples of the present disclosure, the exhaust pipe is provided with an orifice, and the outlet end of the oil discharge pipe is fitted in the orifice.

In other examples of the present disclosure, the orifice of the exhaust pipe is provided close to the exhaust port of the end portion of the exhaust pipe, or the distance between the orifice and the exhaust port is larger than or equal to a minimum predetermined distance. When the pressure difference between the pressure at the orifice of the exhaust pipe and the pressure at the inlet of the oil discharge pipe is sufficient to pump the lubricant at the predetermined oil level into the exhaust pipe, by providing the orifice of the exhaust pipe close to the exhaust port, it is possible to make the structure of the expander more compact.

On the other hand, the orifice of the exhaust pipe may be located at a certain distance from the exhaust port, and the longer the distance, the lower the pressure at the orifice due to the pressure drop, and thus the greater the pressure difference between the orifice of the exhaust pipe and the inlet of the oil discharge pipe. The minimum predetermined distance between the orifice and the exhaust port of the exhaust pipe may be determined according to the minimum pressure difference for pumping the lubricant from the oil sump into the exhaust pipe. Therefore, the orifice of the exhaust pipe may be positioned at a distance from the exhaust port greater than or equal to the minimum predetermined distance.

In other examples of the present disclosure, the housing is further provided with a second opening, and the inlet end of the oil discharge pipe is fitted in the second opening.

In other examples of the present disclosure, the second opening is positioned directly below the first opening in a vertical direction. In other examples of the present disclosure, the exhaust pipe extends toward the horizontal plane where the second opening is located to reduce the height difference between the orifice and the second opening. In other examples of the present disclosure, the oil discharge pipe is provided in a horizontal direction. By reducing the length of the oil discharge pipe or by reducing the height difference between the orifice of the exhaust pipe and the inlet of the oil discharge pipe, it is beneficial to pump the lubricant from the oil sump into the exhaust pipe.

In other examples of the present disclosure, the lubricant discharge channel is defined by a part of the housing and a plate fixed to the part of the housing. In other examples of the present disclosure, the plate has an arc shape. In this way, an additional processing or improvement on the housing of the expander is not required, and an additional installation space is not required.

In other examples of the present disclosure, the lubricant discharge channel is a hole provided in the housing. For this example, only processes such as drilling are required for the housing, without additionally providing members, and thus the number of parts is reduced and the assembly process is simplified.

In other examples of the present disclosure, the lubricant discharge channel extends substantially linearly.

In other examples of the present disclosure, the outlet of the lubricant discharge channel is substantially flush with the wall of the exhaust pipe, or extends into the interior of the exhaust pipe; and/or the outlet of the lubricant discharge channel is substantially parallel to the flow direction of the fluid in the exhaust pipe or oriented obliquely or vertically along the flow direction.

In other examples of the present disclosure, the inlet end and/or the outlet end of the lubricant discharge channel are linear or bent.

In other examples of the present disclosure, the following are provided in the lubricant discharge channel: a one-way valve allowing a fluid to flow from the oil sump into the exhaust pipe, but preventing the fluid from flowing back to the oil sump from the exhaust pipe; and/or a pump configured to pump the lubricant in the oil sump into the exhaust pipe.

In other examples of the present disclosure, the expander is a low-pressure side expander.

According to another aspect of the present disclosure, a fluid circulation system is provided, including the above-mentioned expander.

In other examples of the present disclosure, the fluid circulation system further includes: a condenser; a first exhaust pipe constituting a part of the external system pipeline, and the first exhaust pipe connecting the expander to the inlet of the condenser; and a second exhaust pipe constituting a part of the external system pipeline and connected to the outlet of the condenser. The outlet end of the lubricant discharge channel is connected to the first exhaust pipe or the second exhaust pipe. The problem of insufficient lubrication of the expansion mechanism caused by low lubricant circulation rate may be solved with the fluid circulation system according to the present disclosure.

Other application areas will become apparent through the descriptions provided herein. It should be understood that the specific examples and embodiments described in this section are for illustrative purposes only and are not intended to limit the scope of the present disclosure.

BRIEF DESCRIPTION OF THE DRAWINGS

The drawings described in this section are for illustrative purposes only and are not intended to limit the scope of the present disclosure in any way.

DETAILED DESCRIPTION OF EMBODIMENTS

Figure 1:
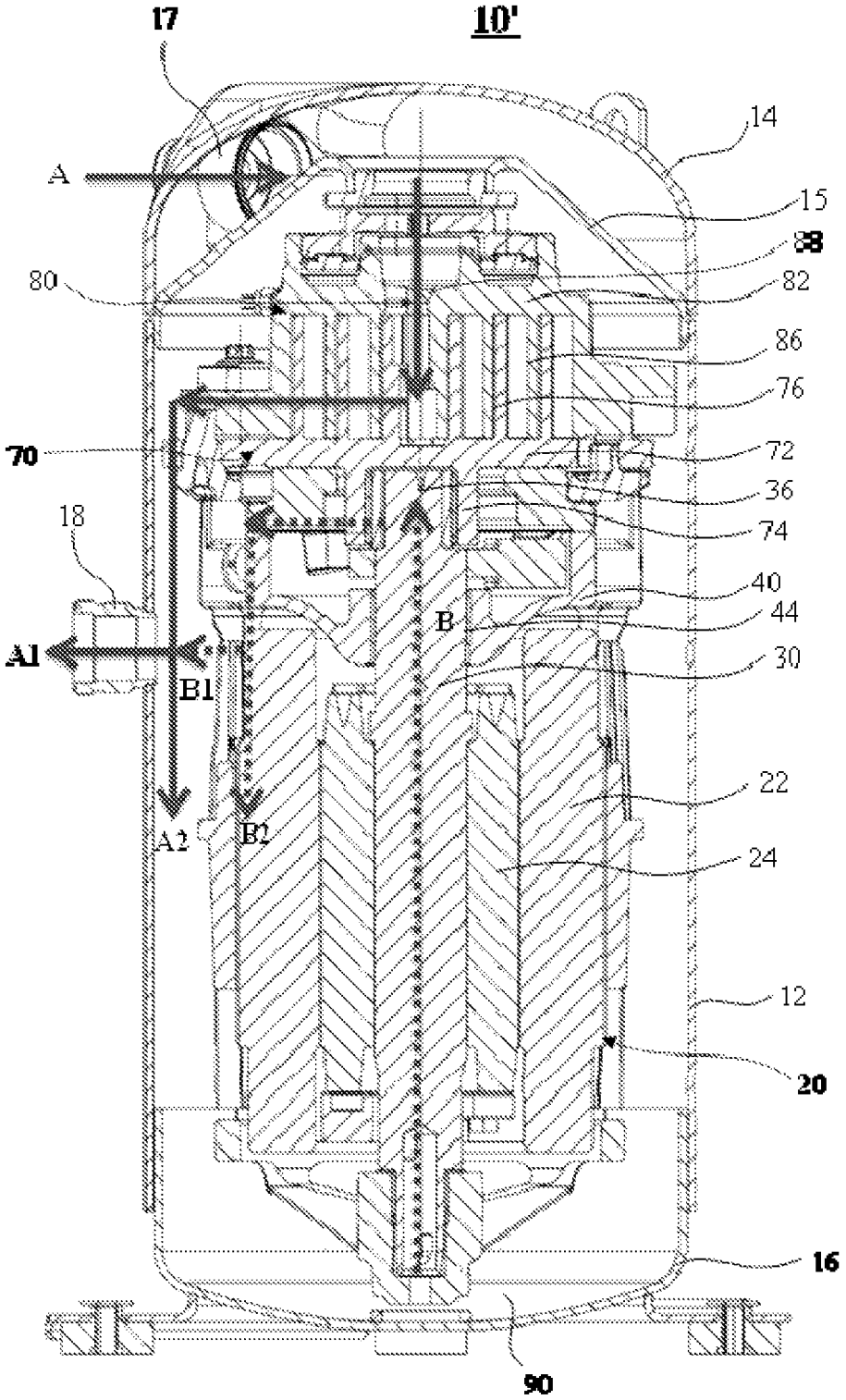
FIG. 1 is a longitudinal sectional view of an exemplary scroll expander.

The following description is only exemplary in nature and is not intended to limit the present disclosure, application, and usage. It should be understood that in these drawings, corresponding reference numerals indicate similar or corresponding components and features.

The basic construction and principle of a scroll expander 10' will be described below with reference to the drawings.

As shown in FIG. 1, the scroll expander (hereinafter also referred to as an expander) 10' includes a substantially cylindrical casing 12, a top cover 14 provided at one end of the casing 12, and a bottom cover 16 provided at the other end of the casing 12. The casing 12, the top cover 14 and the bottom cover 16 constitute a housing of the scroll expander 10' with a closed space.

The scroll expander 10' also includes a partition plate 15 provided between the top cover 14 and the casing 12 to divide the internal space of the expander into a high-pressure side (also referred to as a high-pressure space) and a low-pressure side (also referred to as a low-pressure space). The high-pressure side is formed between the partition plate 15 and the top cover 14, and the low-pressure side is formed among the partition plate 15, the casing 12 and the bottom cover 16. An intake pipe 17 for introducing a high-pressure fluid (also referred to as a working fluid) is provided on the high-pressure side, and an exhaust pipe 18 for discharging the expanded low-pressure fluid is provided on the low-pressure side.

The scroll expander 10' further includes an expansion mechanism composed of a non-orbiting scroll component 80 and an orbiting scroll component 70. The orbiting scroll component 70 may orbit with respect to the non-orbiting scroll component 80 (that is, a center axis of the orbiting scroll component 70 rotates about a center axis of the non-orbiting scroll component 80, but the orbiting scroll component 70 itself does not rotate about its own center axis). The orbiting rotation is achieved by, for example, an Oldham ring (not shown) provided between the non-orbiting scroll component 70 and the orbiting scroll component 80.

The orbiting scroll component 70 includes an end plate 72, a hub 74 formed on one side of the end plate, and a spiral blade 76 formed on the other side of the end plate. The non-orbiting scroll component 80 includes an end plate 82, a spiral blade 86 formed on one side of the end plate, and an inlet 88 formed at a substantially central position of the end plate. Between the spiral blade 86 of the non-orbiting scroll component 80 and the spiral blade 76 of the orbiting scroll component 70, a series of expansion chambers which gradually increase in volume when moving from a radially inner side to a radially outer side are formed.

The radially innermost expansion chamber is adjacent to the inlet 88 and is at a substantially same suction pressure as the introduced high-pressure fluid, thereby also being referred to as a high-pressure chamber. The radially outermost expansion chamber is at a substantially same discharge pressure as the low-pressure fluid to be discharged from the expansion mechanism, thereby also being referred to as a low-pressure chamber. The expansion chamber between the high-pressure chamber and the low-pressure chamber is at a pressure between the suction pressure and the discharge pressure, thereby also being referred to as a medium-pressure chamber.

The high-pressure fluid enters the high-pressure side in the housing of the expander 10' via the intake pipe 17, and then enters the expansion mechanism via the inlet 88. The high-pressure fluid entering the expansion mechanism flows through a series of expansion chambers which gradually increase in volume and is expanded to become the low-pressure fluid. The low-pressure fluid is discharged to the low-pressure side in the housing of the expander 10', and then is discharged out of the expander 10' via the exhaust pipe 18 connected to the housing of the expander 10'.

The expander 10' further includes a main bearing housing 40. The main bearing housing 40 is fixed relative to the casing 12 in a suitable fastening manner. The end plate 72 of the orbiting scroll component 70 is supported by the main bearing housing 40.

The expander 10' may further include a rotating shaft (may also be referred to as an output shaft) 30. The rotating shaft 30 is rotatably supported by a main bearing 44 provided in the main bearing housing 40. An eccentric crank pin 36 is provided at one end of the rotating shaft 30. The hub 74 of the orbiting scroll component 70 drives the crank pin 36 of the rotating shaft 30, thereby rotating the rotating shaft 30. When the expander 10' is operating, a driving torque is generated in the process of expanding the fluid by the expansion mechanism, so as to drive the rotating shaft 30 to rotate to output mechanical or electrical work.

The expander 10' may further include a generator 20 composed of a stator 22 and a rotor 24. The stator 22 is fixed to the casing 12. The rotor 24 is provided between the stator 22 and the rotating shaft 30. The rotor 24 is fixed to an outer circumferential surface of the rotating shaft 30 to rotate together with the rotating shaft 30 when the expander 10' is operating, thereby enabling the generator 20 to generate electricity.

The expander 10' may further include an oil sump 90 in which lubricant (lubricating oil) is stored. As shown in the figure, the oil sump 90 is located at the bottom of the housing of the expander 10', that is, at the bottom cover 16. The rotating shaft 30 is provided therein with a hole (not shown) extending along the longitudinal axis of the rotating shaft and optionally provided with a hole (not shown) extending along the radial direction. When the rotating shaft 30 rotates, a lubricant B is supplied to a movable component such as a bearing via the hole of the rotating shaft 30. A very small part of lubricant B1 of the lubricant after lubricating the movable components is discharged out of the expander 10' via the exhaust pipe 18 with the working fluid, and most of the lubricant B2 is returned to the oil sump 90. A circulation path of the lubricant supplied from the oil sump 90 is schematically shown with a dashed arrow in FIG. 1, and for the convenience of description, the circulation path is referred to as an internal circulation path in the expander.

In addition, a lubricant A is mixed in the high-pressure fluid introduced into the expander 10' via the intake pipe 17. The lubricant A enters the expansion mechanism with the high-pressure fluid, thereby lubricating the non-orbiting scroll component 80 and the orbiting scroll component 70 constituting the expansion mechanism. Most of the lubricant A1 of the lubricant A is discharged from the expander 10' via the exhaust pipe 18 with the working fluid, and a small part of the lubricant A2 separates from the working fluid and flows into the oil sump 90. A circulation path of the lubricant supplied from the outside with the high-pressure fluid is schematically shown with a solid arrow in FIG. 1, and for the convenience of description, the circulation path is referred to as a circulation path in the system.

Generally, the amount of lubricant A2 is greater than the amount of lubricant B1. In this way, after the expander 10' operates for a period of time, the amount of lubricant in the oil sump 90 increases, and the amount of lubricant discharged to the system including the expander via the exhaust pipe 18 decreases. Therefore, when the amount of lubricant entering the expander 10' via the intake pipe 17 with the high-pressure fluid is too little, it may cause insufficient lubrication of the expansion mechanism, thereby causing serious wear of the expansion mechanism, reducing reliability, and even failing.

In order to solve this problem, a lubricant discharge channel 100 is provided in the expander by the inventor according to the Bernoulli effect to discharge the lubricant in the oil sump to the exhaust pipe under the pressure difference between the exhaust pipe and the oil sump.

FIGS. 2*a* to 2*d* show a scroll expander 10 according to an embodiment of the present disclosure. The scroll expander 10 differs from the aforementioned scroll expander 10' in that it further includes an oil discharge pipe 50 for discharging the lubricant in the oil sump into the exhaust pipe, and the oil discharge pipe 50 provides the aforementioned lubricant discharge channel 100. The components of the scroll expander 10 that are the same as those of the aforementioned scroll expander 10' are denoted by the same reference signs, and the description will not be repeatedly described.

As shown in FIGS. 2*a* to 2*d*, the scroll expander 10 further includes the oil discharge pipe 50. The oil discharge pipe 50 includes an inlet end 53 connected to the housing of the expander 10 and an outlet end 51 connected to the exhaust pipe 18. The inlet end 53 of the oil discharge pipe 50 has an inlet 532. The inlet 532 of the oil discharge pipe 50 is positioned substantially at a predetermined oil level, so as to discharge the lubricant reaching the predetermined oil level into the exhaust pipe 18. In this way, it is possible to prevent the lubricant in the oil sump 90 from exceeding the predetermined oil level, that is, to prevent the amount of lubricant in the oil sump 90 from being excessive. The predetermined oil level may be determined based on the operating conditions of the expander and the lubrication conditions of the expansion mechanism and so on. The outlet end 51 of the oil discharge pipe 50 has an outlet 511, and the lubricant in the oil discharge pipe 50 is discharged into the exhaust pipe 18 via the outlet 511.

The casing 12 of the scroll expander 10 is provided with a first opening 121, and an end portion 182 of the exhaust pipe 18 is fitted in the first casing opening 121. The end portion 182 of the exhaust pipe 18 has an exhaust port 181 open toward the interior of the scroll expander 10, such that the low-pressure fluid in the scroll expander 10 enters the exhaust pipe 18 via the exhaust port 181. The first casing opening 121 of the casing 12 forms a first opening of the housing of the scroll expander 10 for mounting the exhaust pipe 18.

The casing 12 of the scroll expander 10 is further provided with a second casing opening 122, and a bottom cover opening 162 is provided in the bottom cover 16, and is in fluid communication with the second casing opening 122. The second casing opening 122 and the bottom cover opening 162 form a second opening of the housing of the scroll expander 10 for mounting the oil discharge pipe 50. The inlet end 53 of the oil discharge pipe 50 is fitted in the second opening of the housing, specifically in the second casing opening 122 in the example shown in FIG. 2*d*.

In the illustrated example, the inlet end 53 of the oil discharge pipe 50 is connected to an overlapping portion of the casing 12 and the bottom cover 16. However, it should be understood that the inlet end 53 of the oil discharge pipe 50 may be connected to a portion where the casing 12 and the bottom cover 16 do not overlap, for example, only to the casing 12 or only to the bottom cover 16. Of course, the position of the inlet end 53 of the oil discharge pipe 50 is mainly determined according to the predetermined oil level.

The exhaust pipe 18 may be provided with an orifice 183, and the outlet end 51 of the oil discharge pipe 50 is fitted in the orifice 183. In the example shown in FIG. 2*c*, the orifice 183 is provided in the end portion 182 of the exhaust pipe 18, that is, close to the exhaust port 181. However, it should be understood that the position of the orifice 183 may be changed according to actual needs.

According to the Bernoulli effect, at the end portion 182 of the exhaust pipe 18, the flow rate of the working fluid is larger, and thus the pressure P1 is smaller; while at the second opening of the housing, the flow rate of the working fluid is close to zero, and thus the pressure P2 is larger. When the oil level of the oil sump 90 is higher than the second opening of the housing, the pressure difference between P2 and P1 causes the lubricant in the oil sump 90 to enter the oil discharge pipe 50 and then enter the exhaust pipe 18. The distribution or circulation path of lubricating oil may be optimized in the expander according to the present disclosure with a simple structure.

Figure 3:
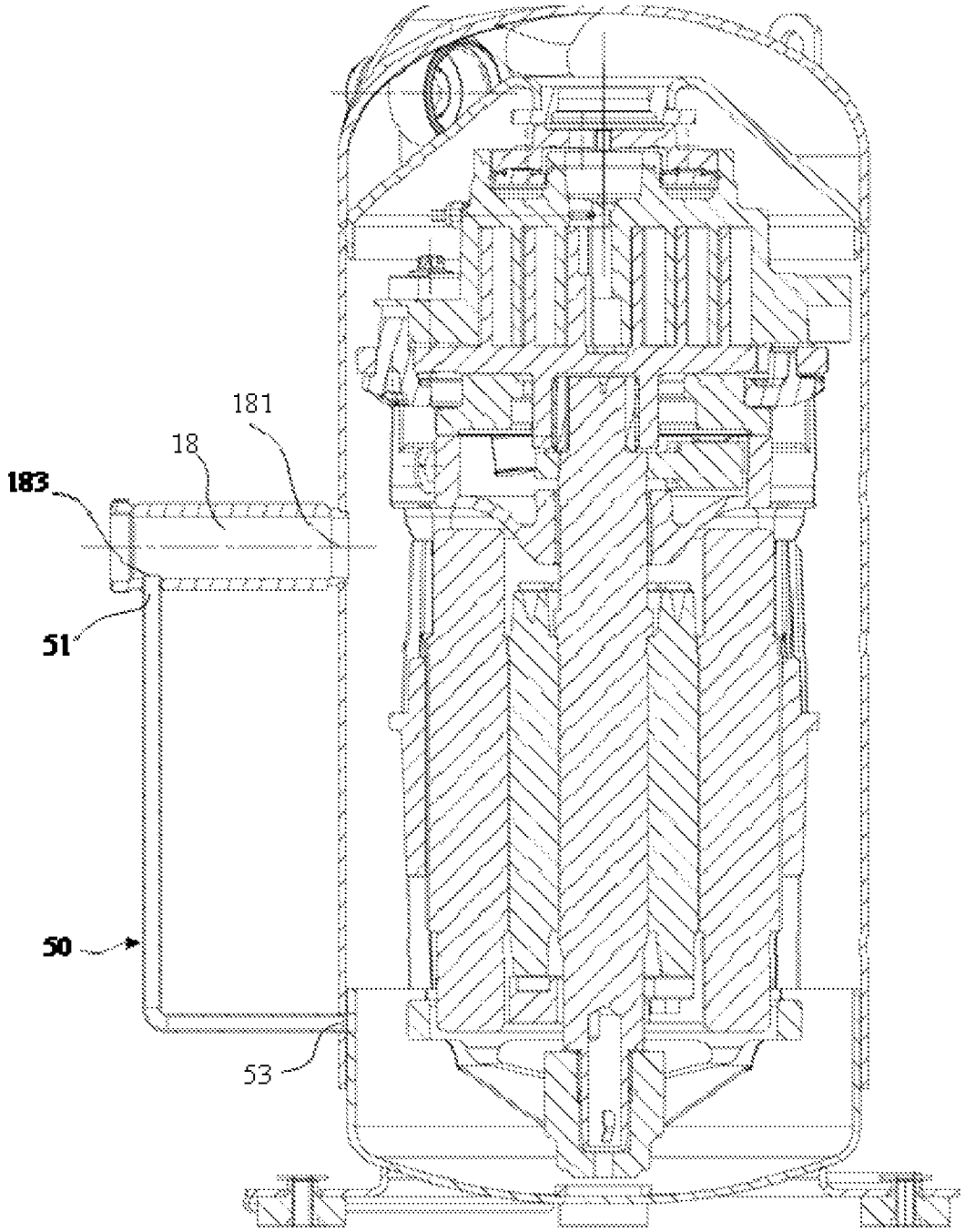
FIG. 3 is a longitudinal sectional view of a scroll expander according to another embodiment of the present disclosure.

Therefore, the greater the pressure difference between P2 and P1, the more beneficial it is to pump the lubricant from the oil sump 90 into the exhaust pipe 18. As shown in FIG. 3, the orifice 183 may be provided at a position away from the exhaust port 181. The working fluid flows from the exhaust port 181 to the orifice 183, and a pressure drop is further generated due to the loss of flow resistance. In this way, the pressure at the orifice 183 is lower than the pressure at the exhaust port 181, and thus the pressure difference between the inlet end 53 and the outlet end 51 of the oil discharge pipe 50 is further increased. The pressure drop between the orifice 183 and the exhaust port 181 may be determined according to the desired pressure difference, and thus a predetermined distance between the orifice 183 and the exhaust port 181 may be determined. Therefore, in a case that the distance between the orifice 183 and the exhaust port 181 is greater than or equal to the predetermined distance, it is possible to ensure that the lubricant may be pumped from the oil sump 90 into the exhaust pipe 18.

Figure 4:
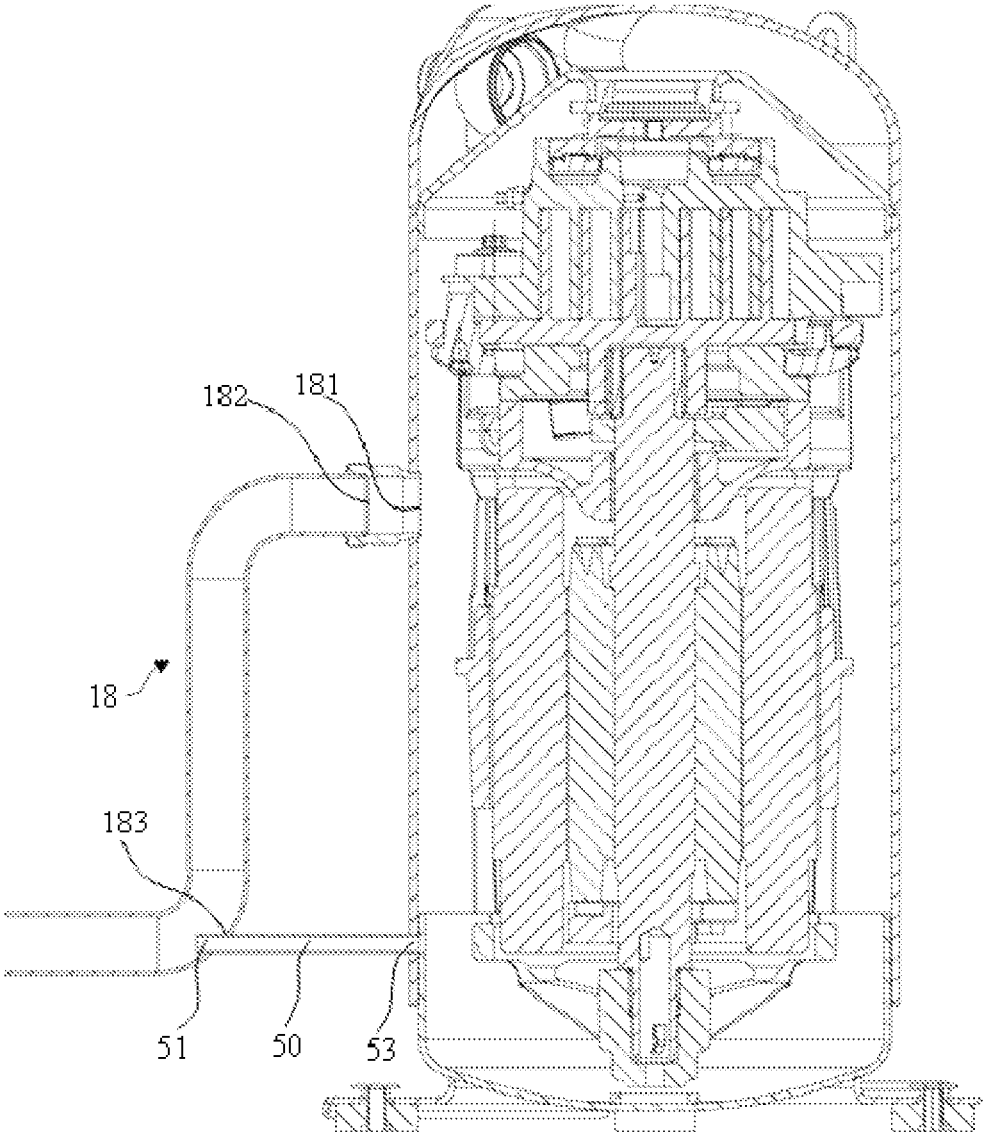
FIG. 4 is a longitudinal sectional view of a scroll expander according to yet another embodiment of the present disclosure.

FIG. 4 is a longitudinal sectional view of a scroll expander according to yet another embodiment of the present disclosure. In the scroll expander shown in FIG. 4, the ability to pump lubricant from the oil sump 90 into the exhaust pipe 18 is further improved by reducing the height difference between the outlet end 51 and the inlet end 53 of the oil discharge pipe 50, that is, by reducing the fluid potential energy to be overcome by the pressure difference. As shown in the figure, the oil discharge pipe 50 is provided in a horizontal direction, that is, in a horizontal plane of a predetermined oil level. In other words, the height difference between the outlet end 51 and the inlet end 53 of the oil discharge pipe 50 is zero. To this end, the exhaust pipe 18 extends or bends downward, that is, extends or bends toward the horizontal plane of the predetermined oil level, thereby making the orifice 183 in the horizontal plane of the predetermined oil level. Compared with the example of FIG. 2*a*, the orifice 183 in the example of FIG. 4 is far away from the exhaust port 181, and thus a greater pressure drop may be generated between the orifice 183 and the exhaust port 181.

Figure 2A:
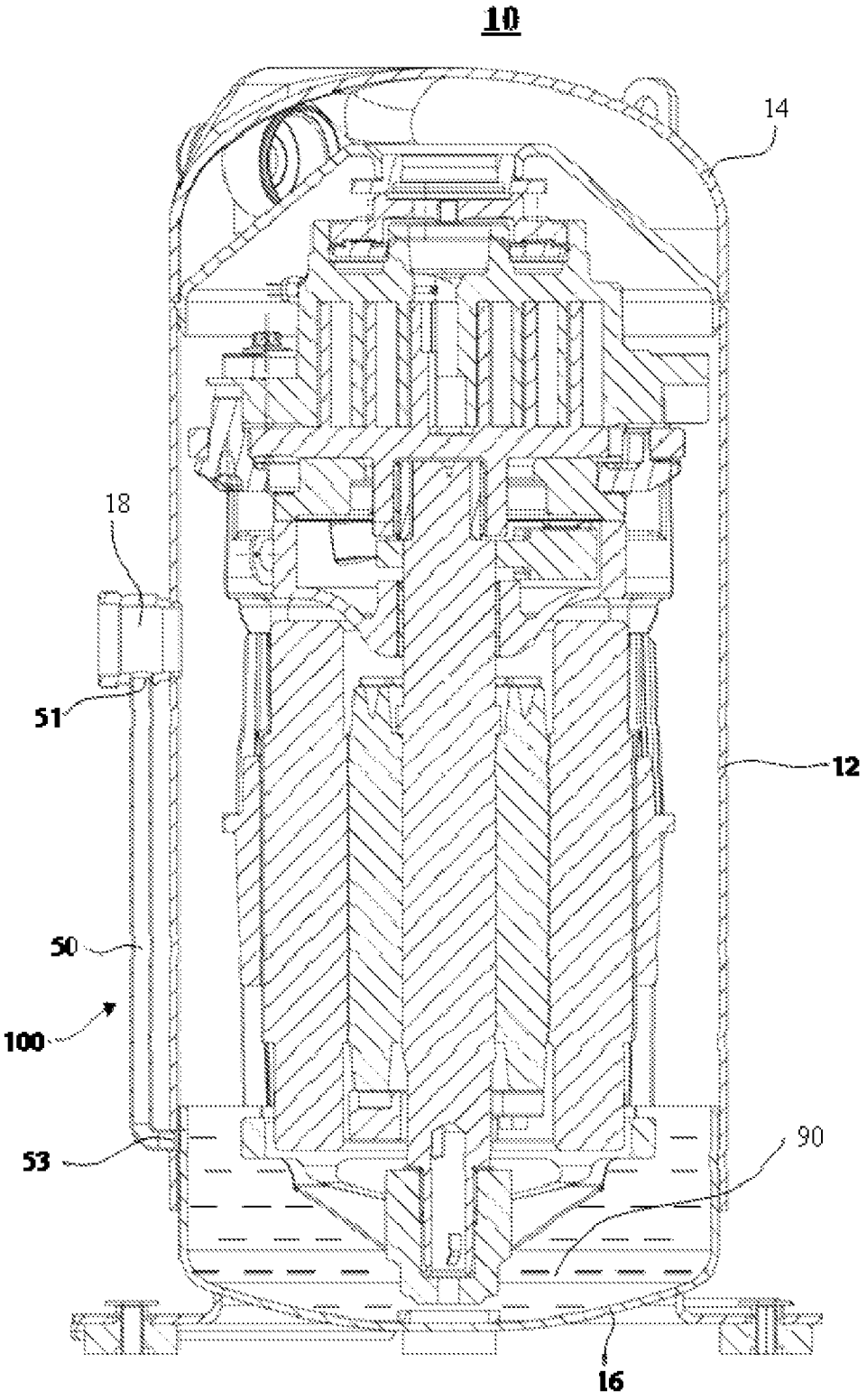
FIG. 2*a* is a longitudinal sectional view of a scroll expander according to an embodiment of the present disclosure.
Figure 2B:
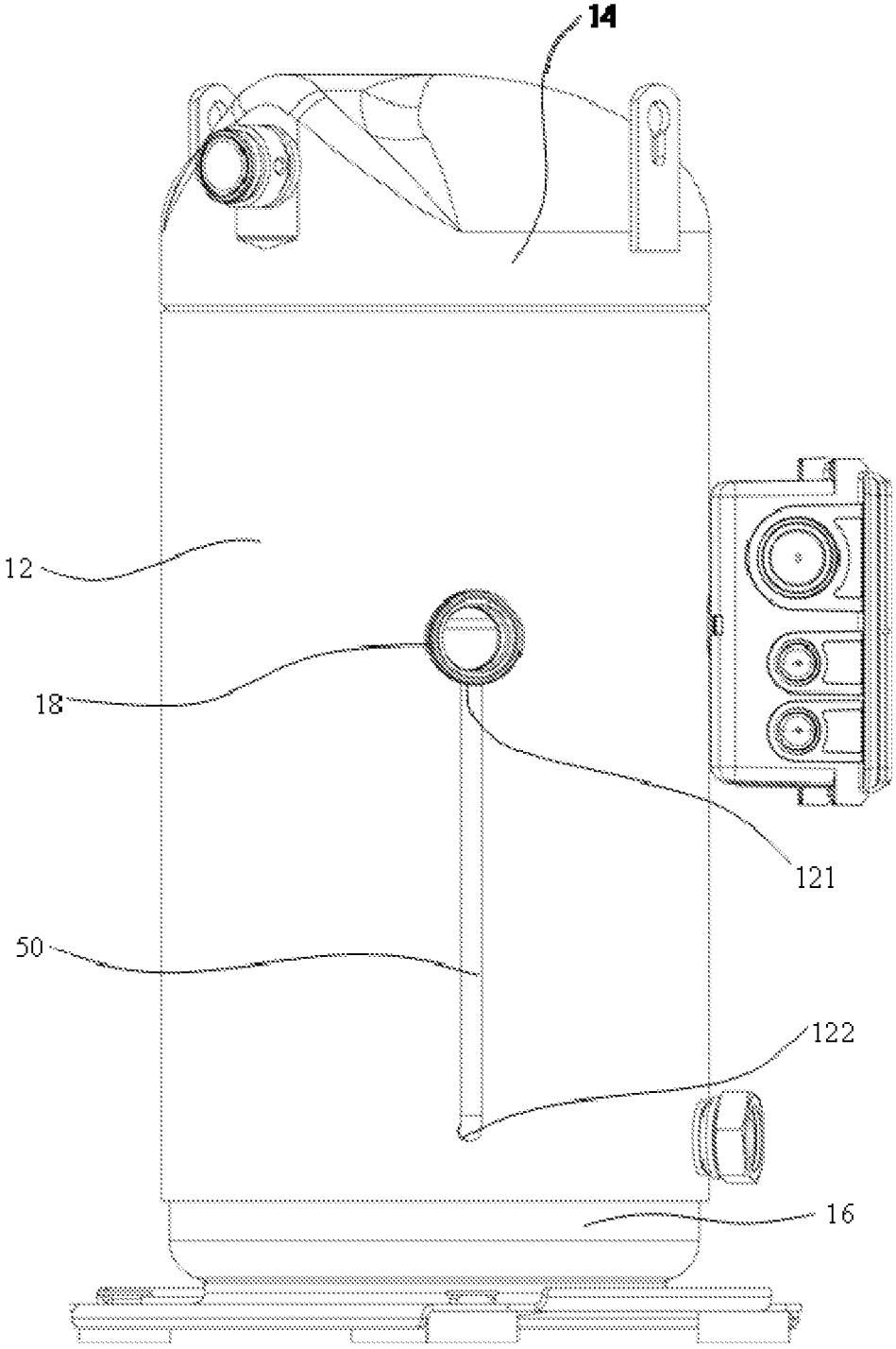
FIG. 2*b* is a schematic view of the appearance of the scroll expander of FIG. 2*a*.

In addition, in the example of FIG. 4, the oil discharge pipe 50 may extend linearly, thereby having a shorter length. In this way, it is beneficial to reduce the flow resistance of the lubricant in the oil discharge pipe 50, and thus the pressure difference for overcoming the flow resistance may be reduced. Another way to reduce for the oil discharge pipe is shown in FIG. 2*b*, the second casing opening 122 (the second opening of the housing) of the cylindrical casing 12 is positioned below the first casing opening 121 (the first opening of the housing) in the vertical direction. The height difference between the first opening and the second opening of the housing may be determined according to the flow rate of the working fluid, the working condition of the expander, the lubrication condition of the movable components, and so on.

Figure 5:
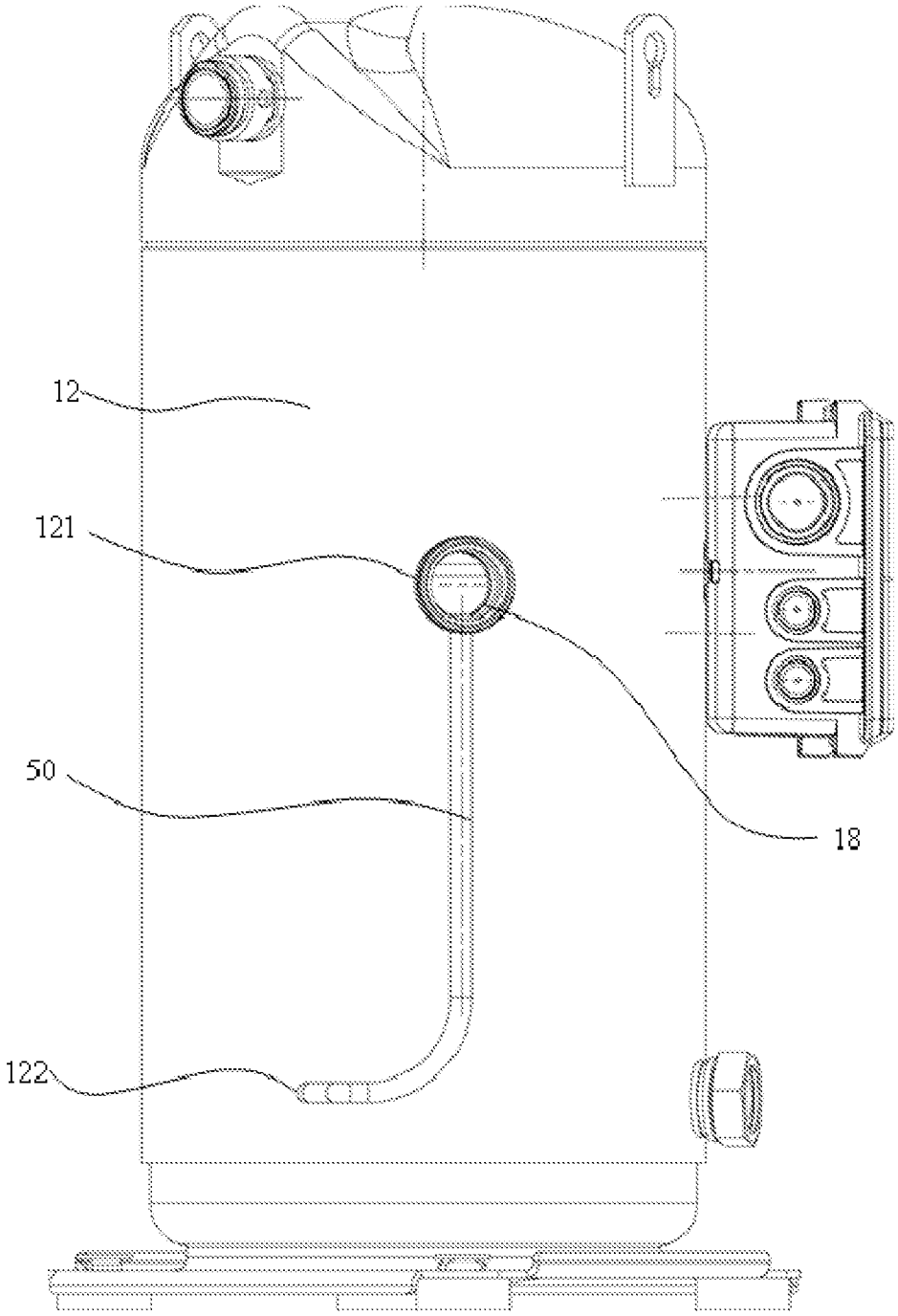
FIG. 5 is a schematic view of the appearance of a scroll expander according to another embodiment of the present disclosure.

However, it should be understood that the positions of the first opening and the second opening of the housing may be changed according to actual needs, that is, the structure of the oil discharge pipe 50 may vary according to the positions of the first opening and the second opening. For example, as shown in FIG. 5, the first casing opening 121 of the cylindrical casing 12 is located above the second casing opening 122, while being spaced apart at a certain distance along the circumferential direction of the cylindrical casing 12, thereby avoiding, for example, the lower bearing housing (in particular, avoiding a support frame supporting the lower bearing housing body).

Figure 6:
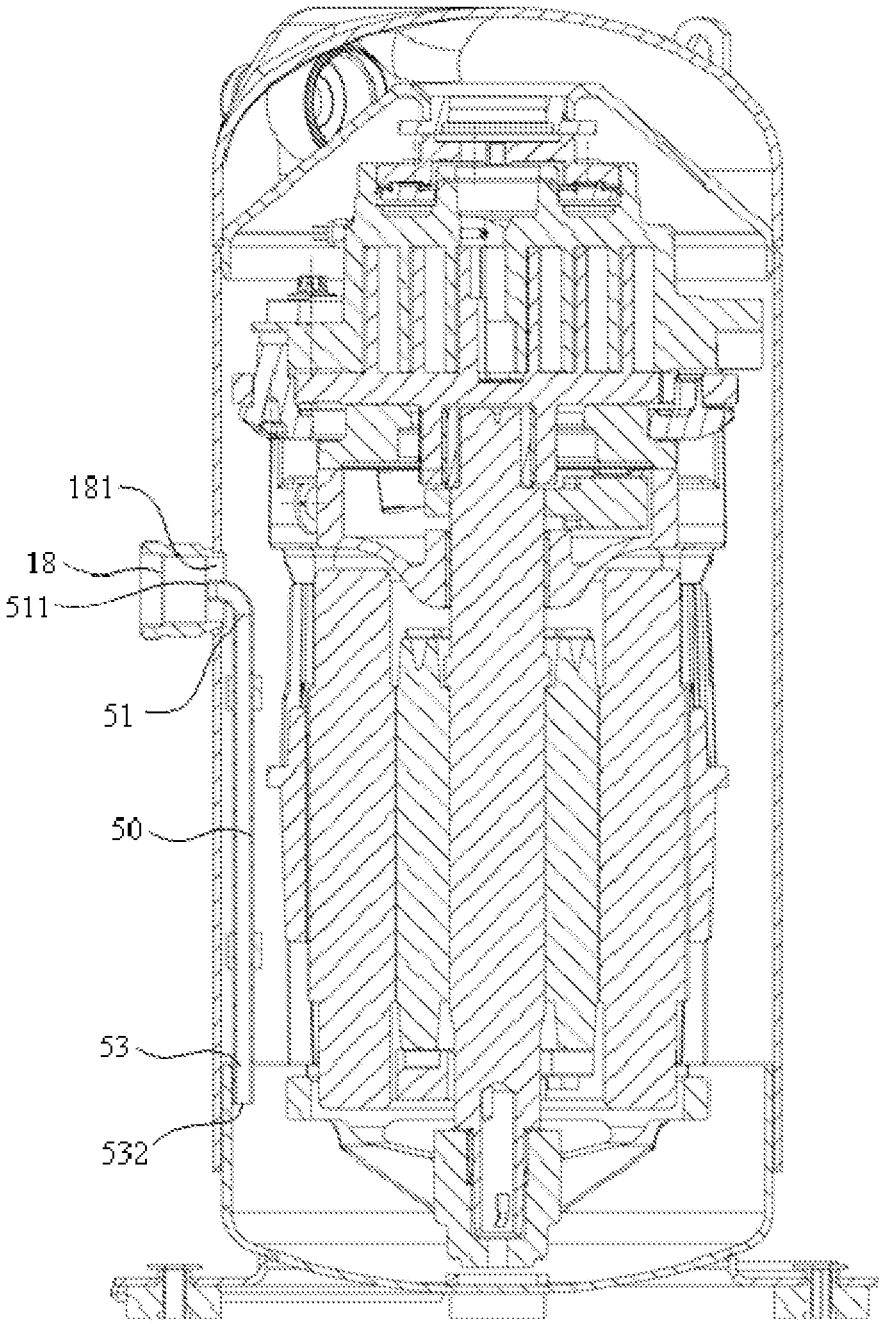
FIG. 6 is a longitudinal sectional view of a scroll expander according to yet another embodiment of the present disclosure.

In the examples of FIGS. 2*a* to 5, the oil discharge pipe 50 is substantially provided outside the expander. However, it should be understood that the oil discharge pipe 50 may also be provided inside the expander. As shown in FIG. 6, the oil discharge pipe 50 is fixed to the inner wall of the housing of the expander. In the example of FIG. 6, the second opening of the housing for installing the inlet end 53 of the oil discharge pipe 50 may be omitted. The outlet end 51 of the oil discharge pipe 50 may extend into the exhaust pipe 18 or may be substantially aligned with the lower wall of the exhaust pipe 18. In this way, the orifice 183 in the exhaust pipe 18 for installing the outlet end 51 of the oil discharge pipe 50 may be omitted. Since the oil discharge pipe 50 is provided inside the housing of the expander, it is possible to make the structure of the expander compact, and thus the installation space is saved.

Figure 7:
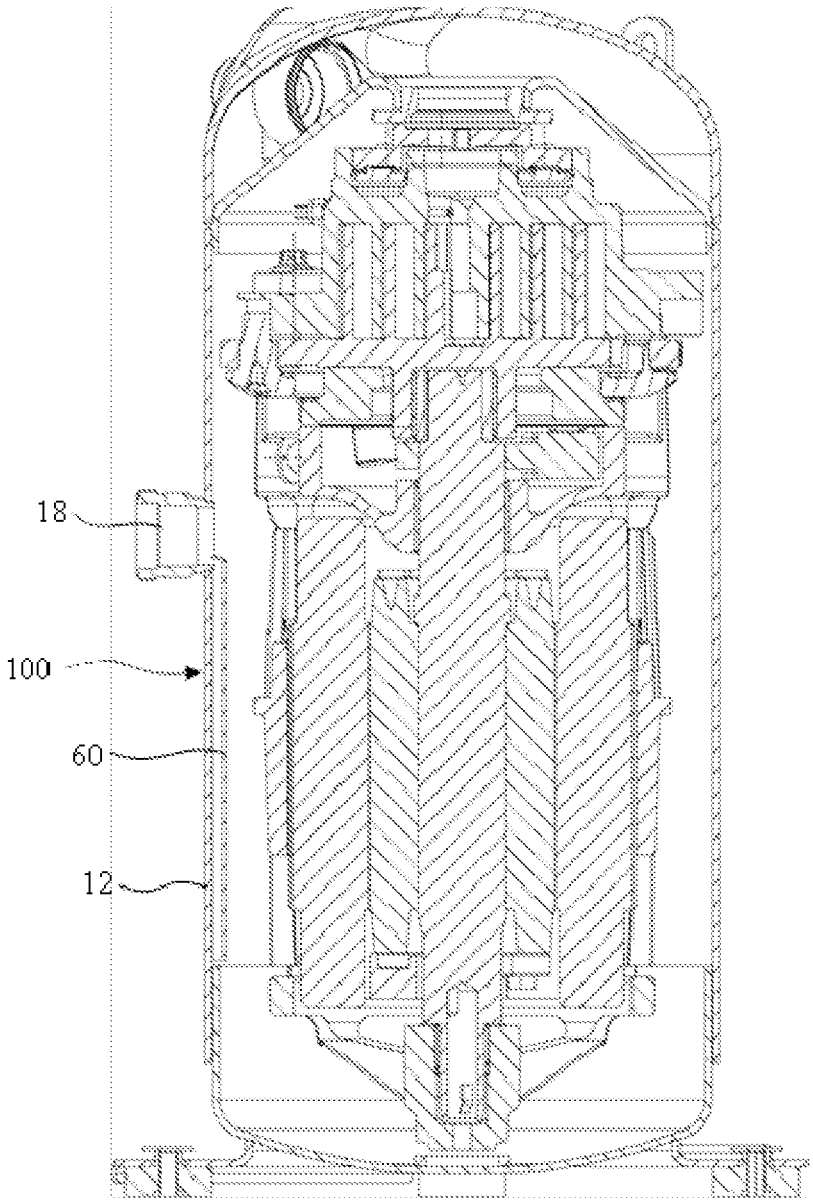
FIG. 7 is a longitudinal sectional view of a scroll expander according to another embodiment of the present disclosure.

FIG. 7 is a longitudinal sectional view of a scroll expander according to another embodiment of the present disclosure. As shown in FIG. 7, the example in FIG. 7 differs from the example in FIG. 6 in the manner in which the lubricant discharge channel 100 is constituted. In the example of FIG. 7, the lubricant discharge channel 100 is defined by a part of the casing 12 and the plate 60. The plate 60 is fixed to the part of the casing 12. Preferably, the plate 60 has an arc shape. The plate 60 may be fixed to the casing 12 by welding, adhesive, and so on.

It should be understood that the manner of forming the aforementioned lubricant discharge channel 100 is not limited to the manner described herein. For example, the lubricant discharge channel may be integrated in the casing 12 (the housing). Specifically, the lubricant discharge channel may be a hole provided in the casing 12 (the housing).

Further, it should be understood that the arrangements of the outlet end and the outlet of the lubricant discharge channel may be determined according to the application and installation conditions, and so on. Preferably, the outlet end and the outlet of the lubricant discharge channel may be provided in a manner that facilitates the flow of lubricant into the exhaust pipe.

Figure 2C:
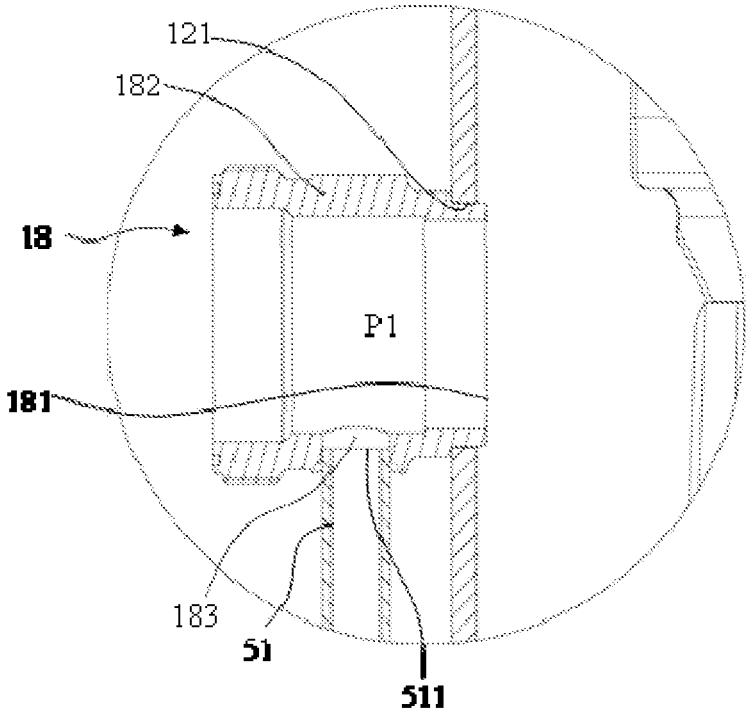
FIG. 2*c* is an enlarged schematic view of a part of an exhaust pipe of the scroll expander of FIG. 2*a*.
Figure 8A:
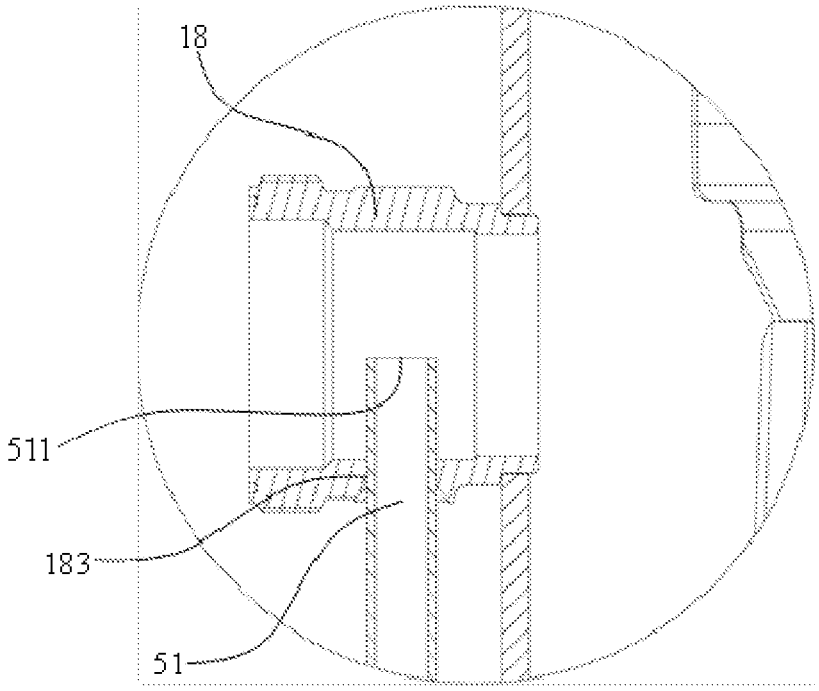
FIG. 8*a* is a schematic view showing a variation of an outlet end of an oil discharge pipe.
Figure 8B:
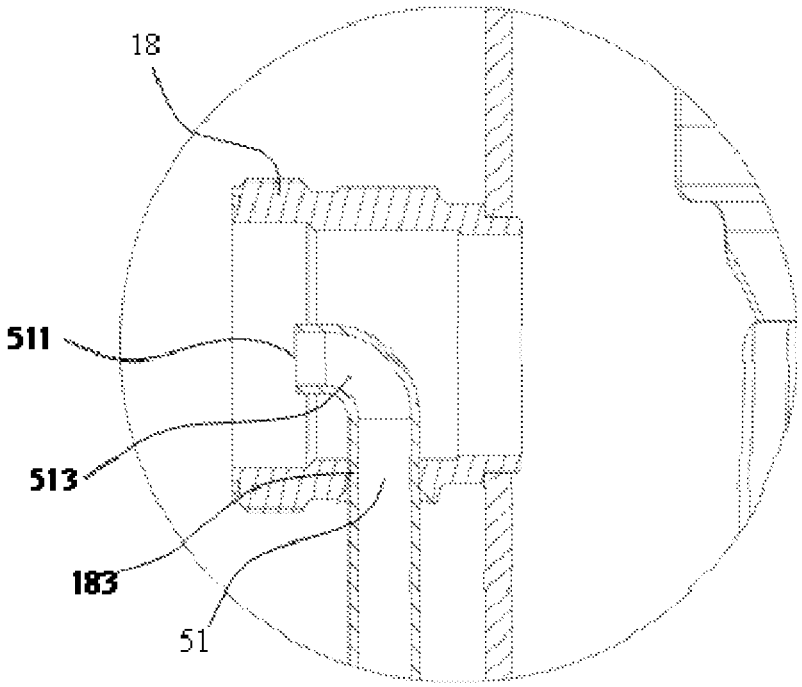
FIG. 8*b* is a schematic view showing another variation of an outlet end of an oil discharge pipe.

As shown in FIG. 2*c*, the outlet 511 of the outlet end 51 is substantially flush with the wall of the exhaust pipe, that is, the outlet end 51 does not protrude into the interior of the exhaust pipe. As shown in FIG. 8*a*, the outlet end 51 may extend into the exhaust pipe 18, that is, extend beyond the orifice 183. In the example of FIG. 8*a*, the outlet end 51 is substantially perpendicular to the central axis of the exhaust pipe 18, that is, the outlet 511 is substantially parallel to the central axis. FIG. 8*b* shows another variation of the outlet end 51. As shown in FIG. 8*b*, the outlet end 51 has an extending portion 513 extending into the interior of the exhaust pipe 18, and the extending portion 513 is bent along the flow direction of the fluid in the exhaust pipe 18. Therefore, the extending portion 513 may also be referred as a bent portion. The extending portion 513 may be configured such that the outlet 511 is substantially perpendicular to the central axis of the exhaust pipe 18, that is, such that the outlet 511 is oriented along the flow direction of the fluid in the exhaust pipe 18. It should be understood that the outlet end of the lubricant discharge channel and the arrangement of the outlet may have various changes, and are not limited to the illustrations and examples described herein. In some examples, other orientations of the outlet are also possible. For example, the outlet may be oblique with respect to the central axis of the exhaust pipe. The cross section of the internal channel of the outlet end 51 may be designed in a manner that facilitates the discharge of lubricant into the exhaust pipe.

Similarly, the arrangements of the inlet end and the inlet of the lubricant discharge channel may be determined according to the application and installation conditions and so on. Preferably, the inlet end and the inlet of the lubricant discharge channel may be provided in a manner that facilitates the flow of lubricant from the oil sump into the lubricant discharge channel.

Figure 2D:
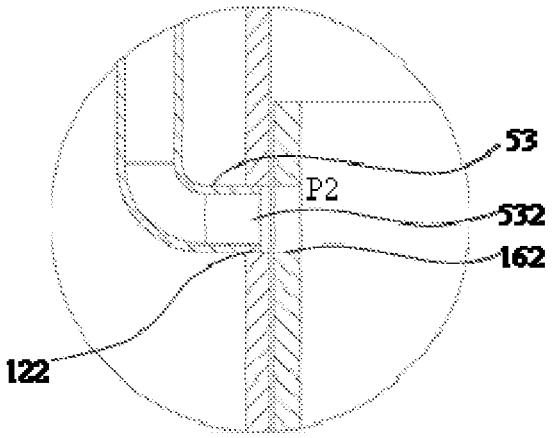
FIG. 2*d* is an enlarged schematic view of a part of an inlet end of an oil discharge pipe of the scroll expander of FIG. 2*a*.
Figure 9A:
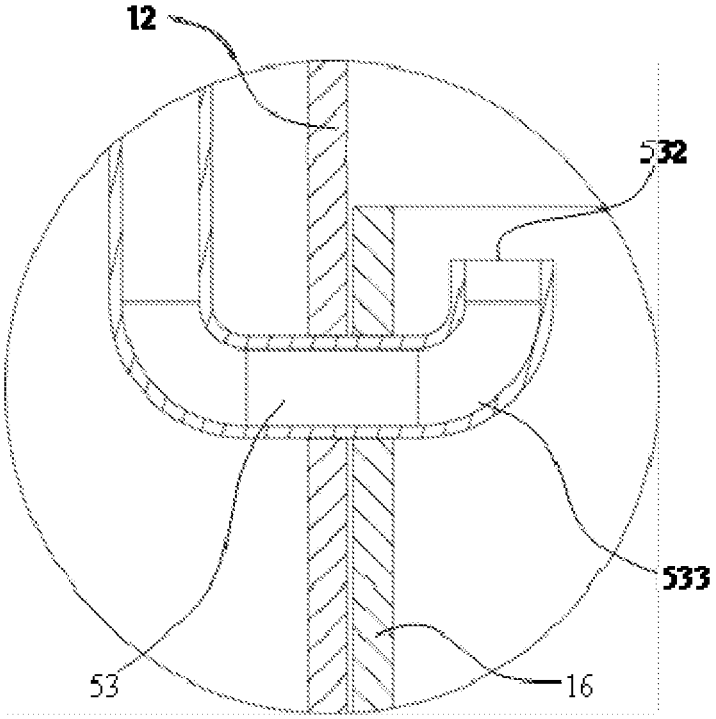
FIG. 9*a* is a schematic view showing a variation of an inlet end of an oil discharge pipe.
Figure 9B:
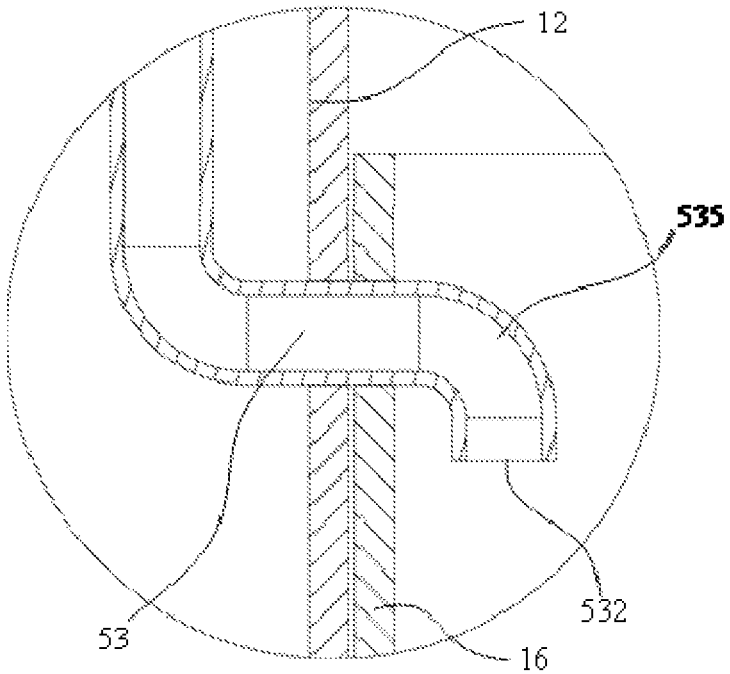
FIG. 9*b* is a schematic view showing another variation of an inlet end of an oil discharge pipe.

As shown in FIG. 2*d*, the inlet 532 of the inlet end 53 is substantially flush with the casing 12 (the housing), that is, the inlet end 53 does not protrude into the interior of the housing. In the example of FIG. 2*d*, the inlet 532 faces the interior of the expander, that is, substantially perpendicular to the horizontal plane of the lubricant. As shown in FIG. 9*a*, the inlet end 53 may extend into the interior of the expander, that is, extend beyond the casing 12 and the bottom cover 16 (the housing). In the example of FIG. 9*a*, the inlet end 53 has an extending portion 533, and the extending portion 533 is bent upward such that the inlet 532 is substantially parallel to the horizontal plane of the lubricant. FIG. 9*b* shows another variation of the inlet end 53. As shown in FIG. 9*b*, the inlet end 53 has an extending portion 535 that is bent downward. It should be understood that the arrangements of the inlet end and the inlet of the lubricant discharge channel may have various changes, and are not limited to illustrations and the examples described herein. For example, the extending portion may be linear, and/or the inlet may be oblique with respect to the horizontal plane. The cross section of the internal channel of the inlet end 53 may be designed in a manner that facilitates the pump of lubricant from the oil sump to the lubricant discharge channel.

Figure 10:
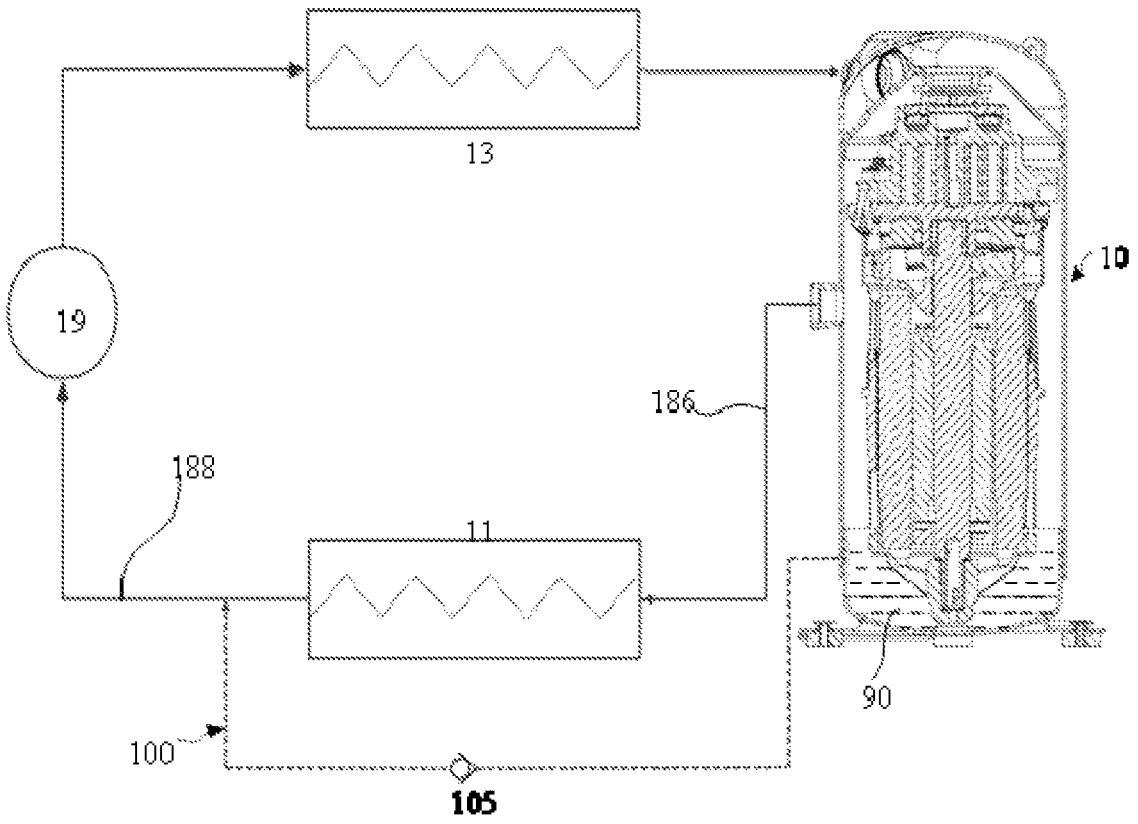
FIG. 10 is a schematic view of a system including an expander according to an embodiment of the present disclosure.

FIG. 10 shows a schematic view of a fluid circulation system using the aforementioned scroll expander. As shown in FIG. 10, the fluid circulation system includes a scroll expander 10, a condenser 11 connected to the scroll expander 10 via a first exhaust pipe 186, a working medium pump 19 connected to the condenser 11 via a second exhaust pipe 188 and an evaporator 13 connected between the working medium pump 19 and the scroll expander 10. The outlet end of the lubricant discharge channel 100 is connected to the second exhaust pipe 188, and the inlet end of the lubricant discharge channel 100 is connected to the scroll expander 10 for discharging the lubricant reaching a predetermined oil level in the scroll expander 10 into the second exhaust pipe 188. Connecting the outlet end of the lubricant discharge channel 100 to the second exhaust pipe 188 may prevent the lubricant from affecting the performance of the condenser.

As shown in FIG. 10, a one-way valve 105 may also be provided in the lubricant discharge channel 100. The one-way valve 105 is configured to allow a fluid to flow from the oil sump 90 of the expander 10 into the second exhaust pipe 188 and enter the system, but prevent fluid from flowing back to the oil sump 90 from the second exhaust pipe 188. Further, in order to ensure that the lubricant is discharged from the oil sump 90 to the second exhaust pipe 188, a pump (not shown) may also be provided in the lubricant discharge channel 100.

It should be understood that the fluid circulation system according to the present disclosure is not limited to the example shown in FIG. 10. For example, the outlet end of the lubricant discharge channel 100 may be connected to the first exhaust pipe 186.

To describe the present disclosure herein, a vertical low-pressure side scroll expander is taken as an example. Then, it should be understood that the present disclosure may be applied to any suitable type of expander, for example, a rotor expander, a horizontal expander, a high-pressure side expander, and so on.

Although various embodiments and some possible variations of the present disclosure have been described in detail herein, it should be understood that the present disclosure is not limited to the embodiments described in detail and shown herein. The various features of the illustrations and the embodiments described above may be combined with each other without conflict, or may be omitted. Other variations and variants may be implemented by those skilled in the art without departing from the essence and scope of the present disclosure. All these variations and variants fall within the scope of the present disclosure. In addition, all the members, components or features described herein may be replaced by other structurally and functionally equivalent members, components or features.

The invention claimed is:

1. An expander, comprising:

a housing;

an expansion mechanism provided in the housing and configured to expand a high-pressure fluid into a low-pressure fluid;

an exhaust pipe configured to discharge the low-pressure fluid out of the expander and comprising an end portion, wherein the end portion is fitted in a first opening of the housing and is provided with an exhaust port via which the low-pressure fluid enters the exhaust pipe;

an oil sump located in the housing and storing a lubricant; and a lubricant discharge channel configured to discharge the lubricant in the oil sump into the exhaust pipe and/or an external system pipeline communicated with the exhaust pipe, wherein the lubricant discharge channel comprises an inlet end having an inlet and an outlet end having an outlet, and wherein the inlet is located at a predetermined oil level of the oil sump, and the lubricant entering the lubricant discharge channel is discharged into the exhaust pipe and/or the external system pipeline via the outlet, and the outlet end of the lubricant discharge channel is located at the end portion of the exhaust pipe which is fitted in the first opening of the housing.

2. The expander according to claim 1, wherein the lubricant discharge channel is provided by an oil discharge pipe.

3. The expander according to claim 2, wherein the oil discharge pipe is fixed to an inner wall of the housing.

4. The expander according to claim 2, wherein the exhaust pipe is provided with an orifice, and the outlet end of the oil discharge pipe is fitted in the orifice.

5. The expander according to claim 4, wherein the orifice of the exhaust pipe is provided in the end portion of the exhaust pipe.

6. The expander according to claim 4, wherein the housing is further provided with a second opening, and the inlet end of the oil discharge pipe is fitted in the second opening.

7. The expander according to claim 6, wherein the second opening is positioned directly below the first opening in a vertical direction.

8. The expander according to claim 6, wherein the exhaust pipe extends toward the horizontal plane where the second opening is located to reduce the height difference between the orifice and the second opening.

9. The expander according to claim 8, wherein the oil discharge pipe is provided in a horizontal direction.

10. The expander according to claim 1, wherein the lubricant discharge channel is defined by a part of the housing and a plate fixed to the part of the housing.

11. The expander according to claim 10, wherein the plate is in an arc shape.

12. The expander according to claim 1, wherein the lubricant discharge channel is a hole provided in the housing.

13. The expander according to claim 1, wherein the lubricant discharge channel extends linearly.

14. The expander according to claim 1, wherein the inlet of the lubricant discharge channel is flush with a wall of the housing, or the inlet end of the lubricant discharge channel extends into the interior of the housing.

15. The expander according to claim 14, wherein the outlet of the lubricant discharge channel is flush with a wall of the exhaust pipe, or the outlet end of the lubricant discharge channel comprises a bent portion extending into the interior of the exhaust pipe so that the outlet is oriented along the flow direction of fluid in the exhaust pipe.

16. The expander according to claim 1, wherein the lubricant discharge channel is provided therein with: a one-way valve allowing a fluid to flow from the oil sump into the exhaust pipe, but preventing the fluid from flowing back to the oil sump from the exhaust pipe; and/or a pump configured to pump the lubricant in the oil sump into the exhaust pipe.

17. The expander according to claim 1, wherein the expander is a low-pressure side expander.

18. A fluid circulation system comprising the expander according to claim 1.

19. The fluid circulation system according to claim 18, further comprising:

a condenser;

a first exhaust pipe constituting a part of the external system pipeline, the first exhaust pipe connecting the expander to an inlet of the condenser; and a second exhaust pipe constituting a part of the external system pipeline, the second exhaust pipe being connected to an outlet of the condenser, wherein the outlet end of the lubricant discharge channel is connected to the first exhaust pipe or the second exhaust pipe.

* * * * *